US006932857B1

(12) United States Patent
Krigmont

(10) Patent No.: US 6,932,857 B1
(45) Date of Patent: Aug. 23, 2005

(54) MULTI-STAGE COLLECTOR AND METHOD OF OPERATION

(76) Inventor: Henry Krigmont, 3600 Marigold St., Seal Beach, CA (US) 90740

( * ) Notice: Subject to any disclaimer, the term of this patent is extended or adjusted under 35 U.S.C. 154(b) by 0 days.

(21) Appl. No.: 10/657,780

(22) Filed: Sep. 8, 2003

Related U.S. Application Data

(63) Continuation-in-part of application No. 10/353,155, filed on Jan. 28, 2003, now abandoned, and a continuation-in-part of application No. 10/400,324, filed on Mar. 26, 2003, now abandoned, which is a continuation-in-part of application No. 09/950,157, filed on Sep. 10, 2001, now Pat. No. 6,524,369.

(51) Int. Cl.[7] ..... B03C 3/155; B03C 3/36

(52) U.S. Cl. ..... 95/63; 55/341.1; 55/361; 95/78; 96/55; 96/59; 96/62; 96/66; 96/73; 96/87; 96/97

(58) Field of Search ..... 96/55, 57–59, 96/62, 70, 73, 79, 86, 87, 97, 66, 98, 99; 95/70, 78, 63, 69; 55/341.1, 361, 372, 379–382, 55/524

(56) References Cited

U.S. PATENT DOCUMENTS

| | | | | |
|---|---|---|---|---|
| 1,345,790 | A | 7/1920 | Lodge | 96/62 |
| 1,356,462 | A | 10/1920 | Nesbit | 96/87 |
| 2,654,438 | A | 10/1953 | Wintermute | 96/62 |
| 3,915,676 | A | 10/1975 | Reed et al. | 55/432 X |
| 4,124,359 | A | 11/1978 | Geller | 55/130 |
| 4,147,522 | A | 4/1979 | Gonas et al. | 55/467 X |
| 4,354,858 | A | 10/1982 | Kumar et al. | 55/DIG. 5 |
| 4,357,151 | A | 11/1982 | Helfritch et al. | 55/302 X |
| 4,375,364 | A | 3/1983 | Van Hoesen et al. | 96/87 |
| 4,411,674 | A | 10/1983 | Forgac | 55/304 |
| 4,874,586 | A | 10/1989 | Szymanski et al. | 55/380 X |
| 4,904,283 | A | 2/1990 | Hovis et al. | 96/66 |

(Continued)

FOREIGN PATENT DOCUMENTS

| | | | |
|---|---|---|---|
| JP | 54158770 | 12/1979 | 96/97 |

OTHER PUBLICATIONS

DOE/FETC/C-97/7284 RA. Dennis "US Dept. of Energy's High-Temp & High Pressure Particulate Cleanup for Advanced Coal-Based Power Systems", Jun. 8-13, 1997.

*Primary Examiner*—Richard L. Chiesa
(74) *Attorney, Agent, or Firm*—Clifford Kraft

(57) ABSTRACT

A multi-stage collector of the type used to collect particles from industrial gas. The collector can contain multiple narrow and wide zones formed by a plurality of parallel corrugated plates. Contained in the narrow zones can be elongated electrodes with sharp leading and/or trailing edges. These electrodes can provide a non-uniform electric field near their sharp edges leading to corona discharge. The corona discharge causes particulate matter in the gas flow to become charged. The region in narrow zones away from the sharp edges of the electrodes resembles a parallel plate capacitor with relatively uniform electric field. In this region, particles can be collected on the plates and on the electrode. Wide regions can contain barrier filters (bag filters) with conductive surfaces. The collector can also be used to clean inlet gas in gasification plants and to collect re-usable materials from a gas stream.

20 Claims, 15 Drawing Sheets

U.S. PATENT DOCUMENTS

| | | | | |
|---|---|---|---|---|
| 5,024,681 | A | 6/1991 | Chang | 95/70 |
| 5,066,313 | A | 11/1991 | Mallory, Sr. | 95/57 |
| 5,158,580 | A | 10/1992 | Chang | 95/70 |
| 5,173,098 | A | 12/1992 | Pipkorn | 55/379 |
| 5,217,511 | A | 6/1993 | Plaks et al. | 55/334 X |
| 5,527,569 | A | 6/1996 | Hobson et al. | 55/382 X |
| 5,531,798 | A | 7/1996 | Engström et al. | 48/77 |
| 5,547,493 | A | 8/1996 | Krigmont | 96/54 |
| 5,547,496 | A | 8/1996 | Hara | 96/79 |
| 5,601,791 | A * | 2/1997 | Plaks et al. | 422/169 |
| 5,938,818 | A | 8/1999 | Miller | 95/63 |
| 5,944,857 | A | 8/1999 | Edwards et al. | 29/25.01 |
| 6,152,988 | A | 11/2000 | Plaks et al. | 95/58 |
| 6,247,301 | B1 | 6/2001 | Brännström et al. | 60/39.12 |
| 6,340,379 | B1 | 1/2002 | Penth et al. | 55/524 X |
| 6,429,165 | B1 | 8/2002 | Nastke et al. | 55/524 X |
| 6,482,371 | B1 | 11/2002 | Rasmussen | 423/1 |
| 6,482,373 | B1 | 11/2002 | Hannaford et al. | 423/47 |
| 6,514,315 | B1 * | 2/2003 | Chang | 95/70 |
| 6,517,786 | B1 | 2/2003 | Best et al. | 422/186.04 |
| 6,524,369 | B1 | 2/2003 | Krigmont | 95/78 |
| 6,527,834 | B1 | 3/2003 | Jörder et al. | 55/524 X |
| 6,544,317 | B2 * | 4/2003 | Miller | 95/63 |

* cited by examiner

MULTI-STAGE COLLECTOR AND METHOD OF OPERATION

This application is a continuation-in-part of application Ser. No. 10/353,155 filed Jan. 28, 2003, now abandoned and Ser. No. 10/400,324 filed Mar. 26, 2003, now abandoned which were continuation-in-part applications of application Ser. No. 09/950,157 filed Sep. 10, 2001, now U.S. Pat. No. 6,524,369, which references Disclosure Document No. 487890 filed in the United States Patent and Trademark Office on Jan. 29, 2001. U.S. Pat. No. 6,524,369 and Disclosure Document No. 487890 are hereby incorporated by reference. Application Ser. Nos. 10/353,155 and 10/400,324 are hereby incorporated by reference.

BACKGROUND

1. Field of the Invention

This invention relates generally to the field of particulate matter collection from discharge gases and more particularly to a multi-stage collector that collects both electrostatically and with barrier filters.

2. Description of Related Art

It is well known in the art how to build and use electrostatic precipitators. It is also known how to build and use a barrier filter such as a baghouse. Further, it is known how to charge particles so that these charged particles may be collected in a barrier filter with lower pressure drop and emissions than uncharged particles collected at the same filtration velocity.

Prior art designs have been discussed in the U.S. Pat. No. 5,547,493 (Krigmont), U.S. Pat. No. 5,938,818 (Miller), U.S. Pat. No. 5,158,580 (Chang), and U.S. Pat. No. 5,024,681 (Chang). Krigmont teaches a new precipitator electrode design/configuration, while the Miller and Chang deal with a combination of a precipitator or electrostatic augmentation and a barrier filter (fabric filter or a baghouse).

An electrostatic precipitator or collector typically consists of two zones: 1) a charging zone where the dust or aerosol particles are charged, usually by passing through a corona discharge, and 2) a collecting zone where the charged particles are separated and transferred from the gas stream to a collecting electrode with subsequent transfer into collecting or receiving hoppers/bins.

The arrangement of these zones has led to two typical prior art precipitator design concepts: a conventional electrostatic precipitator where both zones are combined in a single-stage, and a so-called two-stage design where the zones are separated.

Particulate matter (which may be waste or may be reusable) found in waste gases from industry and power plants (hereinafter called by the generic term "dust"), can have various electrical resistance depending on temperature, humidity and other environmental factors. In particular, the resistance of fly ash depends on gas temperature, gas composition (especially moisture and sulfur trioxide), as well as various other coal or ash properties. Resistance is the result of a combination of surface and volume resistivity. Dust is considered to have high resistance when the particulate resistivity is over about $10^{11}$ ohm-cm. Dust is considered to have a low resistance when the particulate resistivity is lower than about $10^4$ ohm-cm.

The electrostatic precipitation process, in the case of high-resistance dusts, results in some reverse ionization at the side of the collecting electrode at which the dust accumulates. As a result, positively charged dust particles may be released or formed by such reverse ionization, and naturally such positively charged particles are repelled from, and not attracted to, the positively charged dust-collecting surface. As the gas stream passes between the "conventional" dust-collecting electrodes, particles which pick up a positive charge by reverse ionization near to a collecting electrode tend to move toward the next discharge electrode where they may pick up a negative charge. They may then move toward the collecting electrode where they may again pick up a positive charge, etc. The result is a zigzag motion where the particles are not collected.

In the case of low resistance dust, a somewhat similar process takes place due to entirely different phenomena. Low resistance dusts are known for a quick discharging; thus they would be repelled back into the gas stream almost instantly upon contacting the collecting plates, irrespective of their polarity.

Viewed as a statistical phenomenon, particles of dust tend to move in a zigzag fashion between the plane of the discharge electrodes and the collecting electrodes spaced from them as the gas entrains such particles along the collecting path. The zigzag movement is a phenomenon which is associated with both high and low resistance dusts.

Because of the zigzag phenomenon, the effectiveness of dust collection is reduced, and the performance of a dust-collecting or dust-arresting assembly will be substantially lower for high or low resistance dusts than with dust with a the normal resistance range (particulate resistivity between $10^4$ and $10^{11}$ ohm-cm).

Krigmont in U.S. Pat. No. 5,547,493 describes an electrostatic precipitator which utilizes a unique electrode design that provides for separate zones for aerosol particles charging and collection. The dust collecting assembly is a system of bipolar charged surfaces that are constructed in such a way that they provide alternate separate zones for high-voltage non-uniform and uniform electrostatic fields. The surfaces of the electrodes allow combining the charging and collecting zones with non-uniform and uniform electric fields respectively in one common dust arresting assembly. The disadvantage of this design is that it is entirely electrostatic allowing some of the particulate matter to make it past all the electrodes without being collected, especially in the case of high and/or low resistance dust.

Barrier filters (known as baghouse filters) are an alternative to electrostatic collection. They are generally bags through which the gas is made to pass. Conventional designs can be categorized as low-ratio baghouses (reverse-gas, sonic—assisted reverse-gas, and shake-deflate) which generally operate at filtration velocities of 0.76 to 1.27 centimeters per second (1.5 to 2.5 ft/min), also defined as air-to-cloth ratio or volumetric flow rate of flue gas per unit of effective filter area (cubic feet of flue gas flow/min/square foot of filtering area), and high-ratio pulse-jet baghouses which generally operate at 1.52 to 2.54 centimeters per second (3 to 5 ft/min). Baghouses generally have very high collection efficiencies (greater than 99.9%) independent of fly ash properties. However, because of their low filtration velocities, they are large, require significant space, are costly to build, and unattractive as replacements for existing precipitators. Reducing their size by increasing the filtration velocity across the filter bags results in unacceptably high pressure drops and outlet particulate emissions. There is also potential for "blinding" the filter bags, a condition where particles are embedded deep within the filter and reduce flow drastically.

In a barrier filter, the particulate dust is collected on the outside surfaces of the bags while the flue gas passes through the bag fabric to the inside where it exits through the top or bottom of the bags into a clean air plenum and subsequently out the stack. Cages are installed inside the bags to prevent them from collapsing during the normal filtration process. In pulsejet filters air nozzles are installed above each bag to clean the bag. By applying a quick burst of high-pressure air directed inside the bags, the bags are cleaned. This burst of air causes a rapid expansion of the bag and momentarily reverses the direction of gas flow through the bag which helps to clean the dust off the bags.

Because of the small bag spacing and forward filtration through the two rows of bags adjacent to the row being cleaned, much of the dust that is removed from one row of bags is simply recollected on the adjacent rows of bags. Thus, only the very large agglomerates of dust reach the hopper after the burst of air through the bags. This phenomenon of redispersion and collection of dust after bag cleaning is a major obstacle to operating prior art baghouses at higher filtration velocities.

What is badly needed is a particulate collection system that has the high collection efficiency of a barrier filter along with the high filtering velocity of an electrostatic precipitator.

SUMMARY OF THE INVENTION

The present invention is a multi-stage collector that can also be called an electrostatic precipitator even though it may also optionally contain barrier filters.

A multi-stage collector assembly can be made up from discharge electrodes placed between oppositely charged (collecting) electrodes. Each of the discharge electrodes can form two zones: 1) a charging zone and a collection zone. This can be accomplished by using a sharp or pointed leading or trailing edge (or both) on the electrode. This edge can be formed as a discharging part by being provided with sharp edges or thorns where a corona discharge can be generated. The subsequent portion of the electrode can form a flat surface generally parallel to the collection electrodes to first, create a uniform electric field, and second, to form a collection surface for reversely polarized (charged) dust resulting from either reverse ionization (back corona) or purposely bipolarized dust. Charging takes place from a corona discharge at the leading and/or trailing edge of the discharge electrode.

The array can be made from a plurality of corrugated plates where the corrugations on pairs of adjacent plates form alternating wide zones and narrow zones (the distance between the plates in the narrow zones being less than in the wide zones). The discharge electrodes can be located in the narrow zones and can simply be flat plates or shaped structures of various types. These plates or structures can be elongated and generally run the length of the narrow zones in a lateral direction (which will hereinafter be called the vertical direction—it should be noted that it is not necessary that this direction be perpendicular to the earth for the functioning of the invention; rather any direction will work). The gas flows between pairs of these corrugated plates horizontally, perpendicular to the vertical elongated direction of the electrodes (from the end, the gas flow around the electrode would resemble the two-dimensional flow of air around an airplane wing). If a thicker structure is used as an electrode, a sharp or pointed leading or trailing (or both) edge can be provided as the actual discharge point. Any type of discharge electrode can be used and is within the scope of the present invention.

The discharge electrodes can be followed by a barrier filter element located in the wide zone placed between the collecting electrodes along the flow and extending vertically. The barrier filter can be exposed to the direction of flow of the gas and parallel to the collecting electrodes which are plates. The discharge electrodes and barrier filter elements between each pair of plates can lie in a planar array so that the plane of the array is parallel to the direction of flow of the gas stream and to the collecting electrodes. According to the invention, the inner and/or outer surface of the barrier filter can optionally be made conductive.

The corrugated plates can be held at a first electrical potential while the discharge electrodes and a possible conductive surface of the barrier filter can be held at a second electrical potential. The potentials can be DC, AC or pulsed. There is generally a high potential difference or voltage between them. Both the flat sides of each of the discharge electrodes and the surfaces of the barrier filter elements form collecting surfaces where the electric field is relatively uniform.

The surfaces of the barrier filters are generally formed with electric field forming parts that may be suitably rounded and convex in the direction of the plate collecting electrode. The corrugated plate collecting electrodes can be formed with "flat" (narrow) and "round" (wide) sections to accommodate both the discharge electrodes and barrier filter elements. Even though they are being described as "flat", their surfaces may be curved. It should be noted that it is preferred to use barrier filters with electrically conductive outer or inner surfaces or made of conductive material; however, it is also within the scope of the present invention to use nonconductive barrier filters with most electrostatic collection taking place predominantly in the narrow zones. Placing a non-conductive or dielectric material in a high-tension electric field will eventually result in it's becoming charged. Even in this case, because the bags are under relatively lower or ground potential, a portion of dust will still be collected on charged corrugated plates in wide zones as well.

By using an electrode with a cross-section that is relatively wide and thin, a uniform electric field can form in the region of the center of the electrode, and a non-uniform field of high intensity can form at the sharp leading and/or trailing edge. At sufficiently high field strength in this non-uniform field region, a corona discharge will take place between the electrode and the plates thus acting as an ion charging source for dust particles passing through it. The center region of uniform field, on the other hand, acts in a manner similar to the field between parallel capacitor plates with charged dust particles collecting on the plates.

More specifically, dust particles near the corrugated arresting or collecting plate electrode which have been charged to a positive polarity by the positive ions resulting from reverse ionization are conveniently collected by the uniform field-forming part of the discharge electrode. Meanwhile, dust particles around the discharge part (i.e. in the region of the corona-generating means) which are charged to negative polarity are caught by the collecting electrode. The foregoing assumes that the plate collection electrodes are at a relatively more positive (opposite) polarity than the discharge electrodes. Alternate polarities and alternating current or voltage (AC) sources as well as pulse sources are within the scope of the present invention.

The spacing between the discharge points (corona sources) and collecting surfaces are different, wider in the charging or corona generating zones and narrow in the collecting zones where a uniform high voltage electric field is required. This feature allows for the use of a single high voltage power source for all electrostatic fields (in all zones).

A high voltage electric field of an adjustable (variable) frequency and/or alternating polarity could also be applied to the dust arresting assembly to further improve collecting efficiency of bipolar charged aerosol onto the surfaces of both plates, thus substantially increasing the effective collecting area. It should be noted that even though the preferred method is to use a single voltage power source, it is within the scope of the present invention to use multiple voltage power sources.

The zigzag flow of dust particles attributable to reverse ionization is greatly limited, and the performance of the dust-arresting assembly is significantly improved so that high resistance dusts with which reverse ionization is particular problem are intercepted with high efficiency.

Some embodiments of the present invention can be broadly summarized as a system in which multiple stages are utilized, with each stage performing a primary function, and the multiple stages operating synergistically to provide significantly improved overall results.

A major objective of the present invention is to substantially improve fine particulate collection by combining both electrostatic charging/collection and filtration processes, not only by separating zones for particle charging and collecting, but by providing a new unique collector design with improved efficiency to collect fine dust particles independent of the dust resistivity.

Another object of the present invention is to provide a system for cleaning gas at high pressures and temperatures in gasification and fluidized bed combustion plants and other similar applications.

Another object of the present invention is to provide a system for recovering useful materials in waste gas streams.

The present invention generally utilizes an upstream stage comprised of a generally conventional electrostatic precipitator apparatus of the type utilizing a series of corona generating points and accompanying collector plates followed by a downstream zone comprised of the generally parallel surfaces creating uniform electric field, followed by yet another stage which incorporates barrier filters the surfaces of which provide a generally uniform electric field. In this manner, although all zones can be powered by a single power source, each can be designed to generally independently control electric field at an appropriate level. Moreover, by providing continuously repeated stages in series, the downstream zones effectively charge and collect the particles that are either uncollected or re-entrained and collect those particles after they have been charged.

Accordingly, it is an object of the present invention to provide a method and an improved multi-stage collector apparatus, comprising of an ion generating means for introducing unipolar ions into the gaseous effluent, a means for generating a uniform electric field in the regions between the flat surfaces, and the barrier filter means where the medium is flowing through its porous surface. The barrier filter can be made of a conductive porous fabric or a porous medium such as ceramic or sintered, fused or pressed metals to create yet another zone of uniform electric field. The porous media itself can be conductive, but more likely there is either a conductive surface on the fiber, or conductive fibers (such as carbon) are embedded or entwined in the porous media.

A further object of the present invention is to provide a multi-stage collector apparatus wherein the "uniform-field" regions have a high uniform electric field, and wherein the ion current density in the "uniform-field" regions can be sufficiently small to control back corona without any penalty in the reduction of the average field and still be sufficient to hold collected particles to the collecting plates prior to their removal.

Another object of the present invention is to provide an improved collector apparatus, which incorporates an ion generating means and uniform electric field generating means that have an improved corona discharge apparatus within it.

Yet another object of the present invention is to provide an improved multi-stage collector apparatus that includes a downstream region that utilizes an improved barrier filter means which, with the collector apparatus, achieves superior operating results in terms of power efficiency and overall fine particle removal from the gaseous medium.

Still another object of the present invention is to provide a novel means for reducing back corona in localized areas within precipitating apparatus of the above type.

A further objective of this invention is to provide an improved multi-stage collector design which avoids the problems of earlier systems and allows for increased efficiency in removal of sub-micron dusts and aerosols with reduction of required collecting surface.

It should be understood that the invention is not necessarily limited to the particular embodiments illustrated herein.

DESCRIPTION OF THE INVENTION

Figure 1:
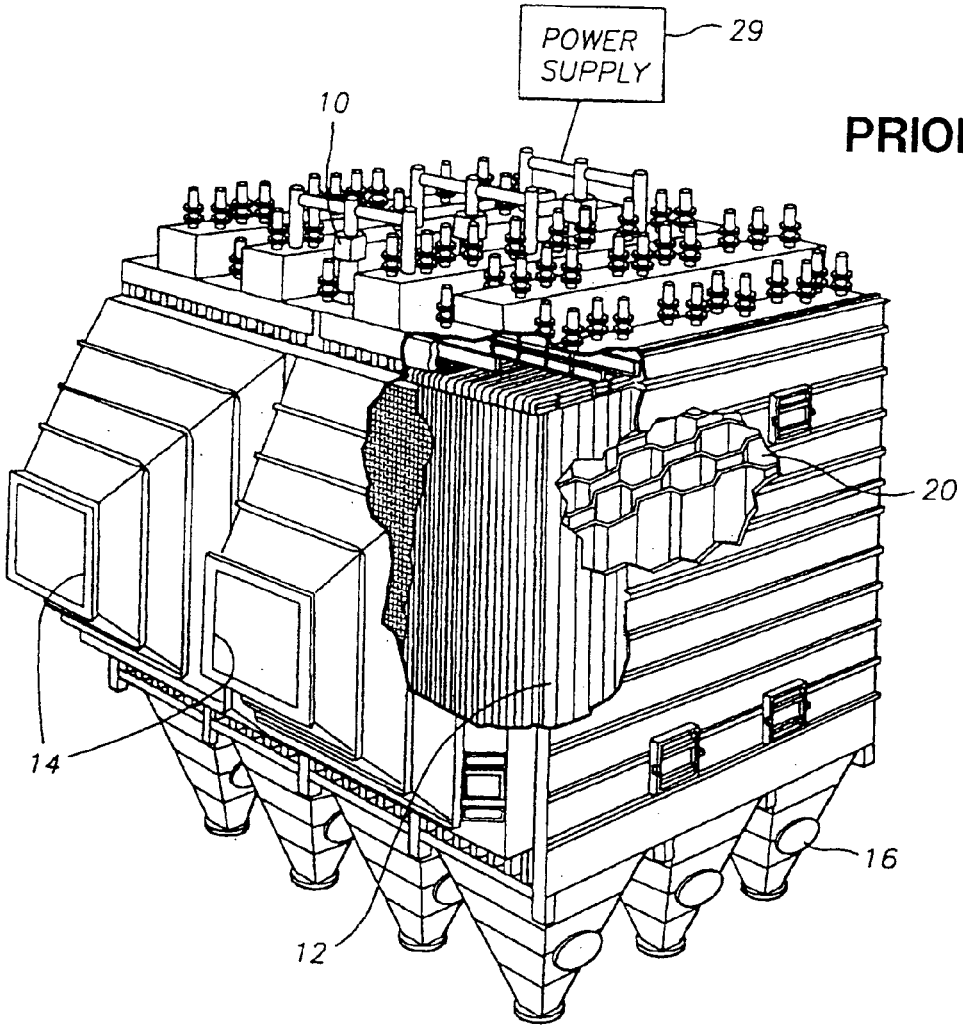
FIG. 1 shows a prior art electrostatic precipitator. The present invention can resemble such a unit with the improved techniques described herein.

Turning to FIG. 1, a prior art electrostatic precipitator is seen. A power supply 29 powers pairs of corrugated plates separated to form zones. Effluent gas enters the assembly from ports on the side 14 and passes through exiting on the other side (not shown). When the plates are rapped to clean, the collected dust falls to hoppers in the bottom where it can be removed 16. The array assembly 12 shown in detail in 20 is simply the plate corrugations of the alternately positive and negatively charged plates.

The present invention can be fitted into a similar assembly as that shown in FIG. 1 as will be described.

Figure 2:
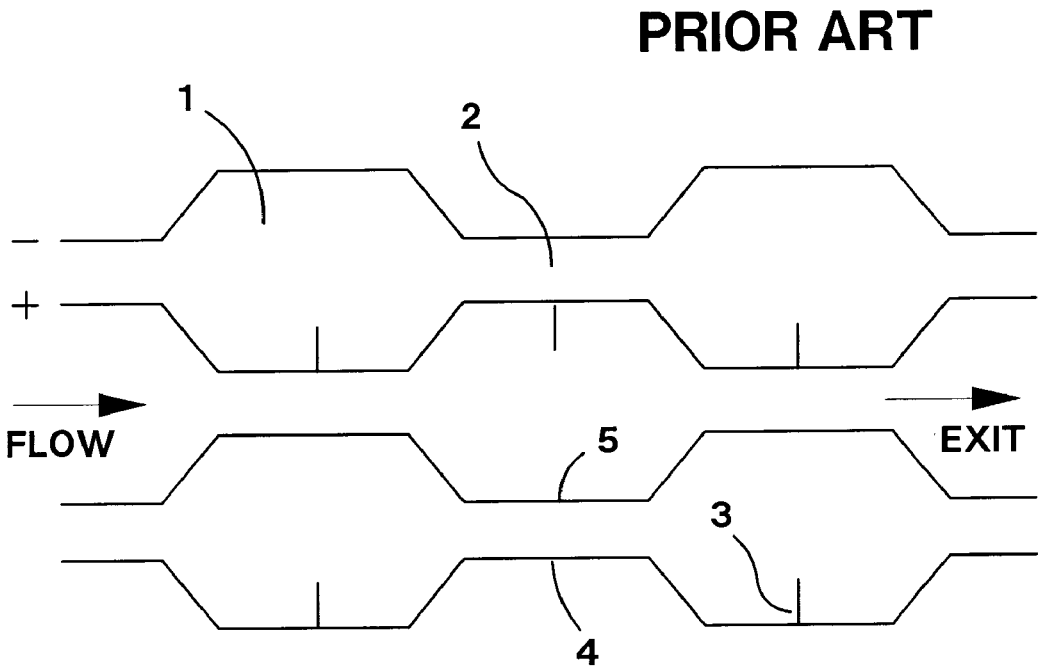
FIG. 2 shows a prior art electrostatic precipitator array.

FIG. 2 shows a pair of the corrugated plates 4, 5 from the prior art assembly of FIG. 1. Wide 1 and narrow 2 zones are seen. Electrodes 3 are attached to one of the plates and located in the wide zones 1 to produce a corona discharge.

Figure 3:
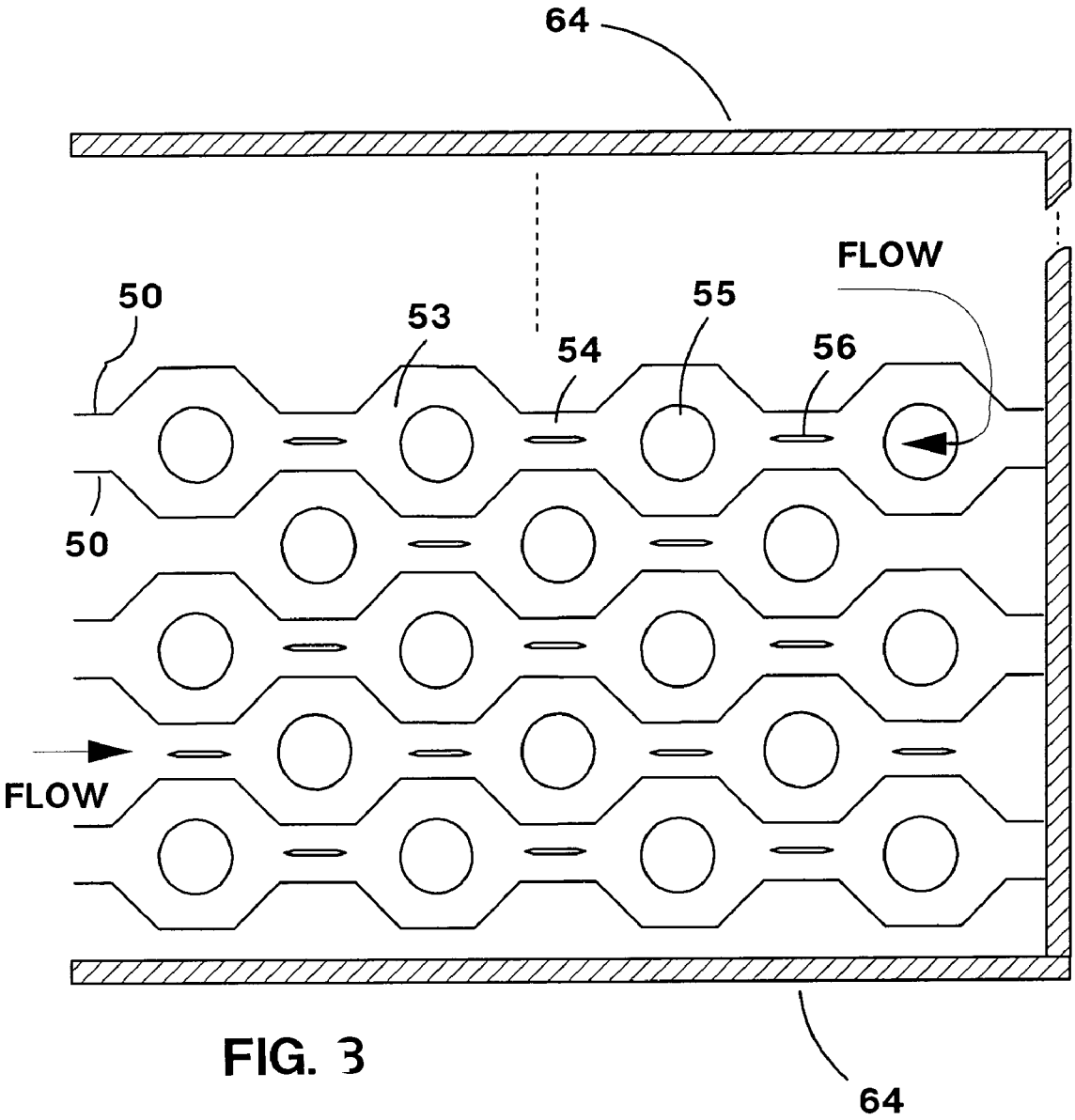
FIG. 3 shows an embodiment of a filtering array described in an embodiment of the present invention.

FIG. 3 shows an array that forms an embodiment of the present invention. A plurality of corrugated plate electrodes 50 form cells containing wide zones 53 and narrow zones 54. The plates 50 are positioned so that entering gas flows between them. However, in the present invention, the narrow zones 54 can each contain at least one flat, elongated (in the 3rd dimension, out of the paper) electrode 56 with sharp leading and/or trailing edges. The elongated electrode 56 can be positioned in the gas flow so that the gas flows around it (like airflow around an airplane wing). The wide zones 53 can contain barrier filters 55 (shown as circles in FIG. 3) which can be conventional bag filters. However the surface of the barrier filters 55 of the present invention can be conductive. The gas flow shown in FIG. 3 remains between pairs of corrugated plates 50. The flow never crosses between regions defined by these pairs. The flow arrows in FIG. 3 are for illustration only.

The entire assembly shown in FIG. 3 can be enclosed with a sealed end wall 64 preventing further flow of the gas in the direction parallel to the corrugated plates 50. Rather, the gas flow is normally between the plates and parallel to them with some of the gas exiting through the side of each barrier filter (bag) 55. The sealed wall 64 prevents further gas flow in the longitudinal direction of the plates and forces all gas to exit the assembly through the barrier filters 55 (the only exit).

Figure 4:
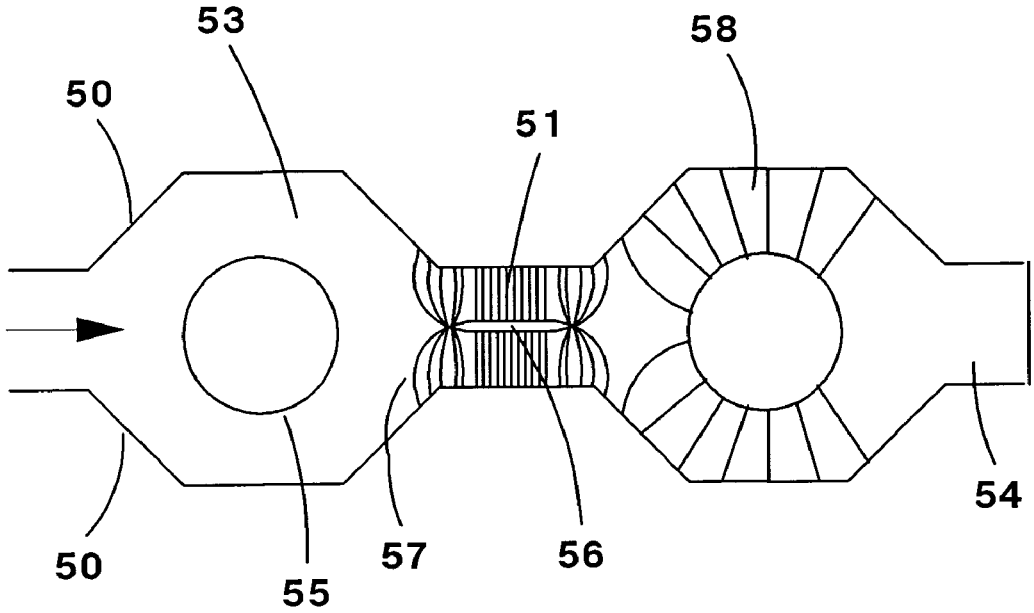
FIG. 4 shows a detail view of the electric field in the narrow and wide zones in the embodiment of FIG. 3.

Turning to FIG. 4, the operation of the present invention will now be explained. FIG. 4 shows zones formed by two of the parallel corrugated plates 50. The flat elongated electrode 56 and the barrier filters 55 can be clearly seen. The corrugated plate electrodes 50 are held at a first electrical potential, while the flat elongated discharge electrode 56 and the conductive surface of the barrier filter 55 are held at a second electrical potential or a second and third electrical potential. The preferred method of operation of the invention is to hold the elongated electrodes 56 and the surface of the barrier filters 55 at ground potential with a high voltage applied to the corrugated plates 50. However, it should be understood that the present invention can be operated at any potentials different enough to cause corona discharge at the sharp edges of the elongated electrodes at any polarities. In particular, the polarities can be reversed either statically or dynamically, or the apparatus can be operated with AC or pulsed voltage applied. While the elongated electrodes and the barrier filters are usually operated at the same potential with respect to each other, this is not necessary. It is within the scope of the present invention to use a third potential and operate the elongated electrodes and the barrier filters at different potentials.

FIG. 4 also shows a partial depiction of the electric field in the narrow and wide zones. At the leading and/or trailing edges of the flat, elongated electrodes 56 the electric field 57 is non-uniform and is adjusted to cause a corona discharge from the pointed edge of the elongated electrode 56 to the corrugated plate 50. Thus, gas flowing toward the electrode 56 passes through a discharge of ions in the corona with dust particles becoming charged. The electric field 51 near the center of the flat elongated electrodes 56 is relatively uniform and resembles the field between the plates of a parallel plate capacitor. Charged dust passing through this narrow zone is collected either at the corrugated plate 50 or on the elongated electrode 56.

The electric field 58 in the wide zone is also relatively uniform and resembles the field between the plates of a concentric cylindrical capacitor. Particles entering this zone are collected electrostatically either on the surface of the corrugated plate 50, electrostatically on the conductive surface of the barrier filter 55, or on the fabric or material of the barrier filter 55 by normal filtering action. The barrier filter 55 can be a fabric cloth bag or a porous material such as a porous ceramic or metal. The barrier filter surface can also contain embedded catalysts for the removal of other materials such as mercury or other contaminants from the gas or for conversion (reduction, oxidation) of actual gas components. A common catalyst is vanadium pentoxide which can optionally be coated (and possible baked) onto surfaces. The outer or inner surface of the barrier filter 55 can be made either of a conductive material or conductive with either a conductive layer or with impregnated conductive material or fibers (or the entire filter can be made of conductive material). Catalysts can also optionally be pelletized or granules loaded in a clean gas plenum of the filter. It should be noted that any type and location of any catalyst is within the scope of the present invention.

Values of the electric fields in the various zones can be around 6–13 kV/cm in the wide zones; the non-uniform field in the narrow zone can be around 2–6 kV/cm, and the uniform field in the narrow zone can be around 6–13 kV/cm. Of course with a given potential difference, and with the elongated electrodes 56 and the barrier filters 55 at the same potential, the uniform field in the narrow zones may be greater than the uniform field in the wide zones. The exact field strength in each zone will depend on the exact geometry and potentials used. The basic idea is that the voltage (potential difference) will be set to a value to cause the desired corona discharge from the discharge points. The geometry can be designed to achieve the desired uniform fields.

Although the barrier filters 55 in FIGS. 3 and 4 are shown with circular cross-sections, any cross section is within the scope of the present invention that leads to a relatively uniform field in the wide zones. In particular, an elliptical cross-section can be used to increase the uniformity of the field in the wide zones and to increase the surface area of the barrier filter element for greater collection and filtering.

Figure 5:
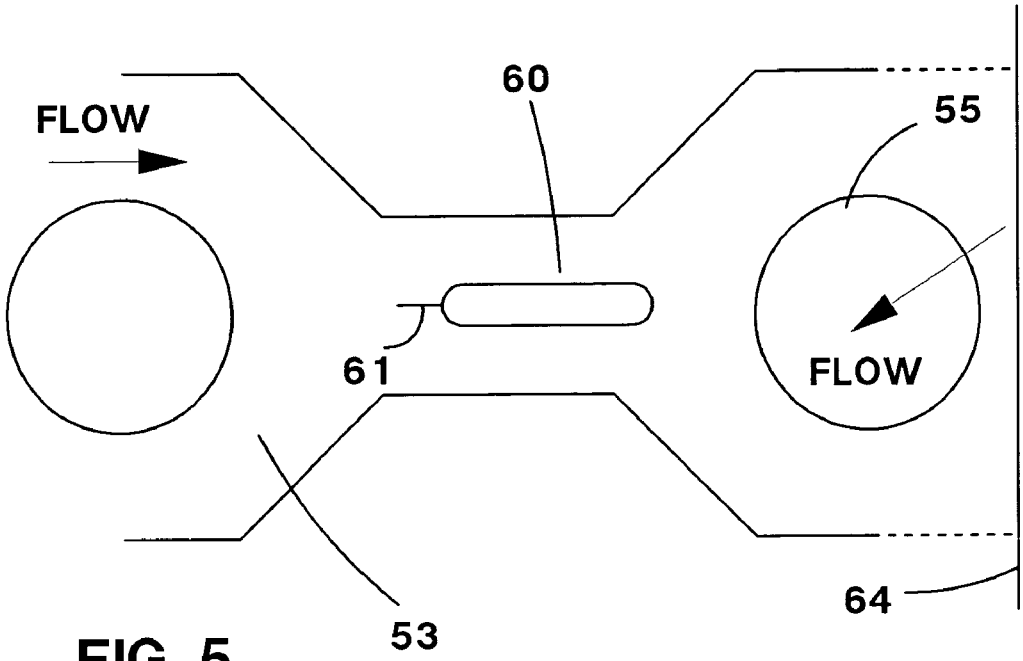
FIG. 5 shows details of a narrow zone with one type of electrode.
Figure 6A:
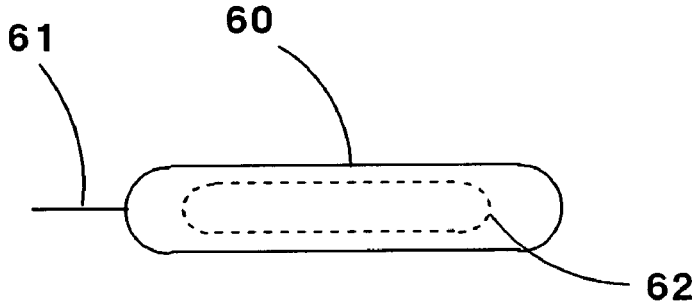
FIGS. 6A–6B show details of one embodiment type of a discharge electrode.
Figure 6B:
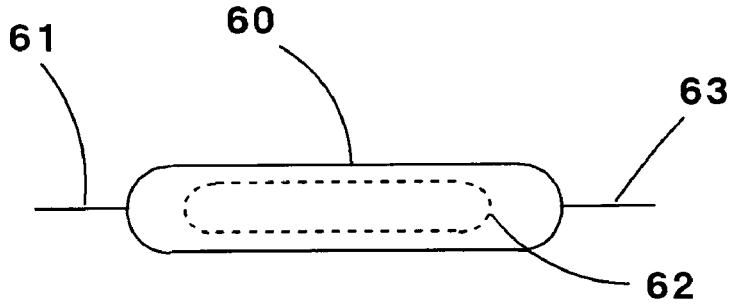

FIG. 5 shows one embodiment of a narrow and wide zone and of a particular cross-section and design 60 of the flat, elongated electrode (56 in FIGS. 3 and 4). In FIG. 5, the electrode 60 is elongated with a rounded front. Extending from the rounded front is a sharp thin plate or wire 61, which acts as the discharge point for the corona discharge. FIG. 6A shows the electrode 60 from FIG. 5 with the optional feature of a hollow core 62. FIG. 6B shows the same electrode 60 with two discharge points 61, 63 on a leading and trailing edge. It should be remembered that it is within the scope of the present invention to have discharge point(s) on leading and/or trailing edges of the electrode 60. Thus, it is within the scope of the present invention to reverse left to right the embodiment of FIGS. 5 and 6A so that the discharge point 61 appears on the trailing edge. Also, the discharge points can take many different sharp or pointed geometric forms.

Figure 7A:
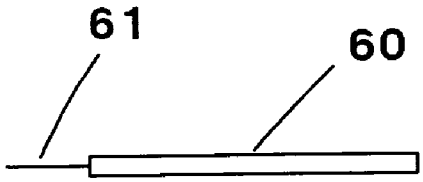
FIGS. 7A–7C show details of different embodiment types of discharge electrodes.
Figure 7B:
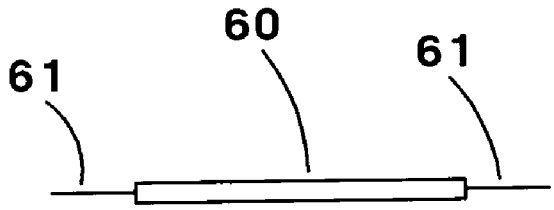
Figure 7C:
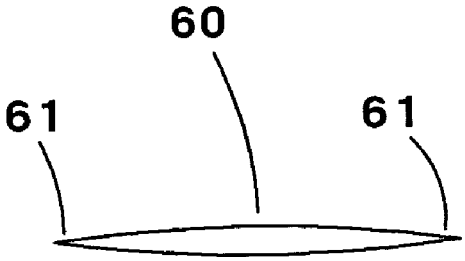

FIGS. 7A, 7B, and 7C show a different embodiment of the elongated electrode 60 in the form of a flat plate with a sharp leading edge 61, a flat plate with a sharp leading and trailing edge 61, or a contoured shape with sharp leading/or trailing edges. It is within the scope of the present invention to simply use a very thin flat plate alone as the flat elongated discharge electrode.

Figure 8:
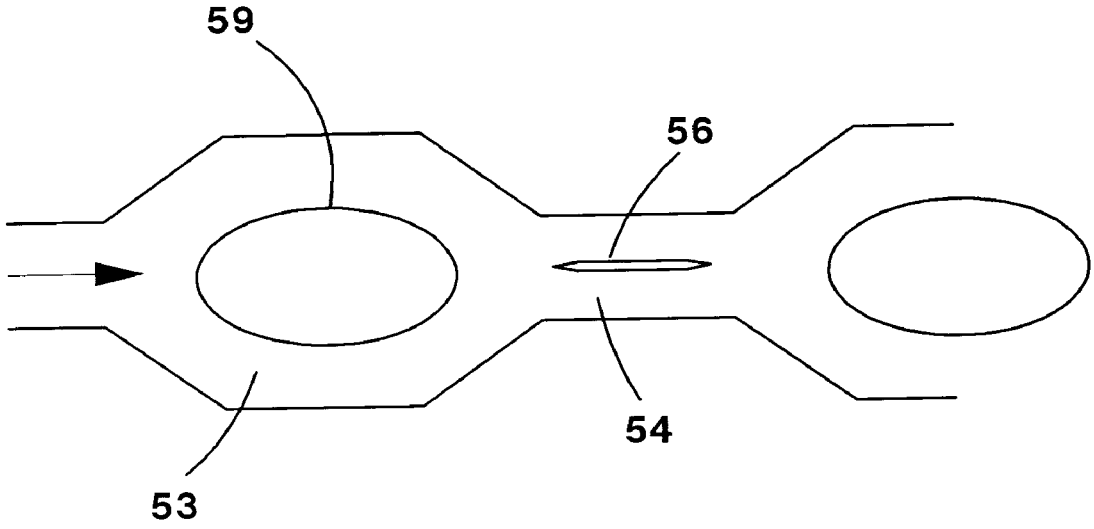
FIG. 8 shows a partial array where the barrier filters are elliptical.

FIG. 8 shows an embodiment of wide 53 and narrow 54 zones with a plate type elongated electrode 56 and a barrier filter 59 with an elliptical cross-section. Any cross-section that yields a relatively uniform electric field in the wide zone 53 is within the scope of the present invention. It is possible to also use a standard non-conductive bag filter in some or all of the wide zones 53 with no or little electric field in these regions.

Figure 9:
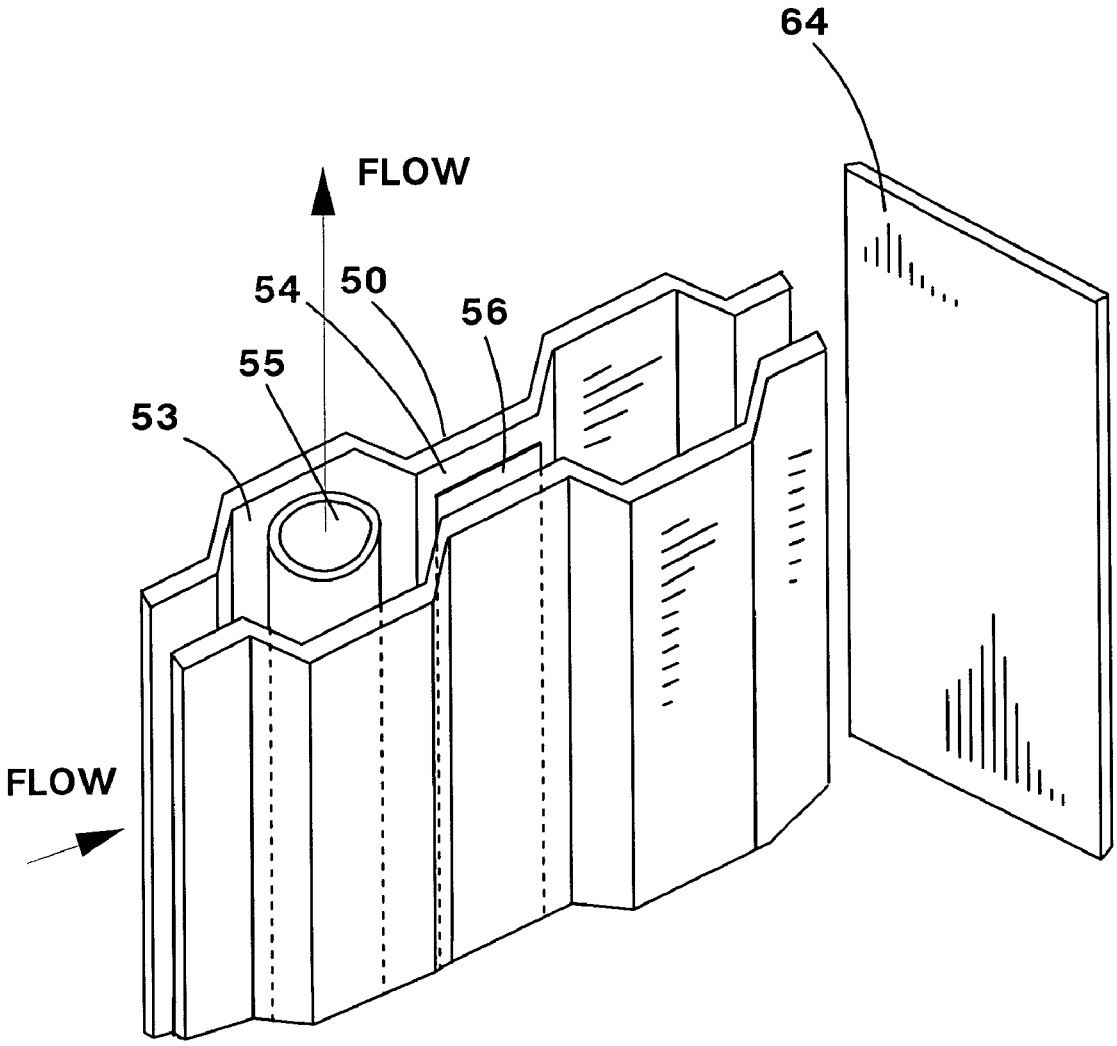
FIG. 9 shows a perspective view of a pair of corrugated plates forming narrow and wide zones with one discharge electrode and barrier filter shown.

Turning to FIG. 9, a perspective view is seen of a typical array formed by two of the plurality of corrugated plates 50. The wide zones 53 and the narrow regions 54 are clearly seen. The flat, elongated discharge electrode 56 is positioned in the narrow regions 54 and extends vertically the length of the zone. A barrier filter 55 is seen in the wide zones 53 also extending the length of the zones. While it has been stated that the barrier filter and the elongated electrode extend the length of the zone, this is not a requirement for the present invention. While it is preferred that they extend the length of the zone for maximum filtering, embodiments are possible where they are shorter or longer. A solid wall 64 is shown in FIG. 9. This wall closes off the horizontal flow and causes all the gas to exit the array through the barrier filters. Various configurations of this wall are possible and are within the scope of the present invention.

Figure 10:
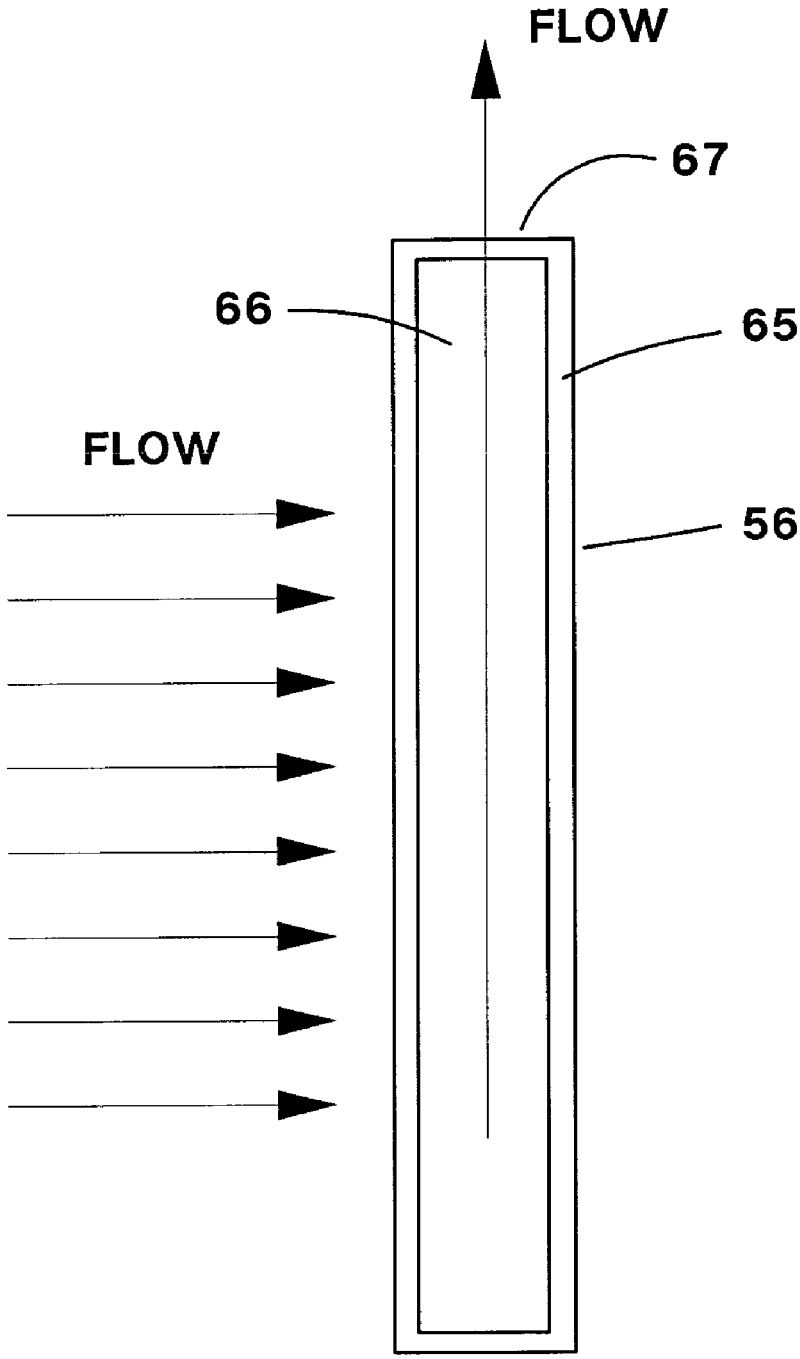
FIG. 10 shows a side view of a barrier filter depicting the gas flow through the side of the filter and out the top.

FIG. 10 shows a side view of a representative barrier filter. The surface of the filter 65 can be made of fabric or a porous material such as a porous ceramic or any other porous material. Either surface 65 of the filter can be made conductive with a conductive layer, embedded conductive particles, or embedded conductive fibers, or the entire filter can be conductive. One type of conductive fiber is carbon. The gas flow passes through the side 65 and possibly the top or bottom of the barrier filter into the hollow center 66 and exits from the top 67 (or from the bottom). The conductive surface 65 and material of the bag should be such that there is good filtering action and also enough pass-through so that excessive back pressure does not build up in the flow. As previously stated, the surface of the barrier filter can also contain catalysts to perform chemical processing of other types of contaminants in the gas.

Figure 11:
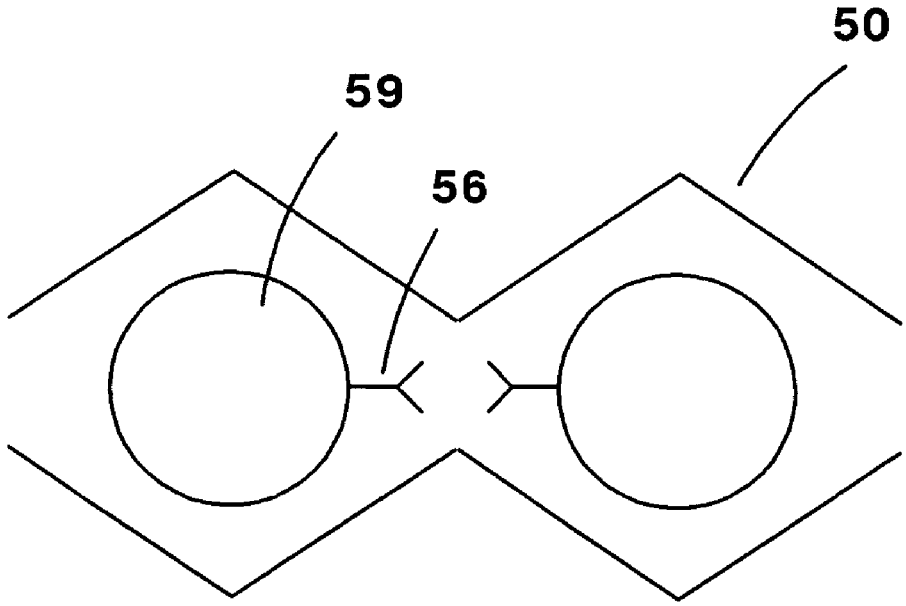
FIGS. 11–12 show embodiments with discharge electrodes attached to the barrier filters.
Figure 12:
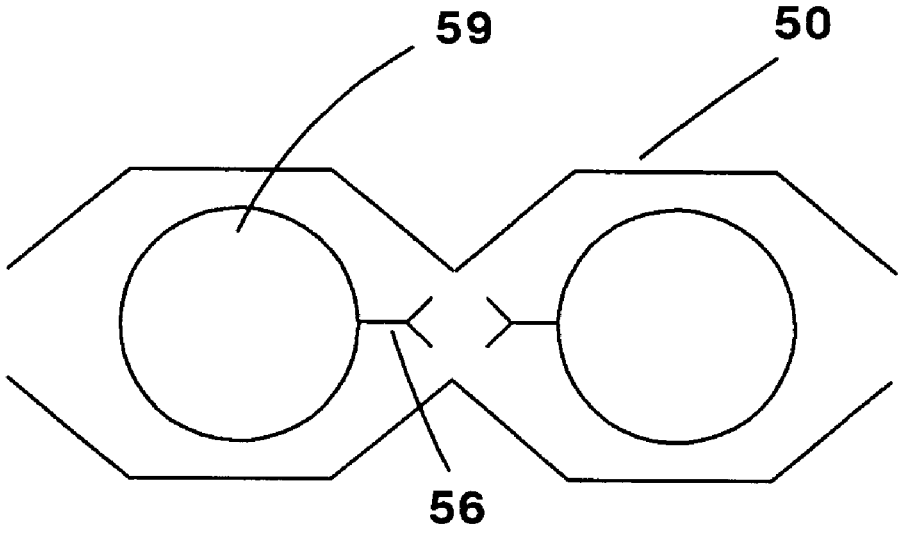

FIGS. 11–12 show an embodiment of the present invention where electrodes 56 are directly and electrically attached to barrier filters 59 between the charged plates 50. This embodiment allows a very simple construction of the electrode. It should be remembered that the shape or design of the electrode is of no importance to the functioning of the present invention. Electrodes can be any shape or size and can be any discharge electrode known in the art including, but not limited to, wires, plates, springs, pipes, saw-stripes and any other electrode design. The electrode will generate ions no matter what its shape and will thus provide a supply of ions so that particulate matter can be collected.

Figure 13:
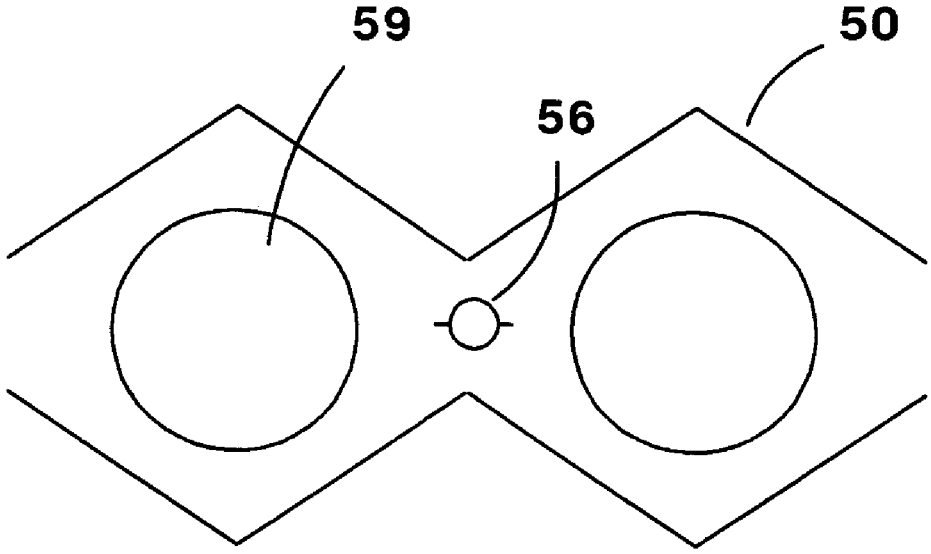
FIGS. 13–15 show embodiments with discharge electrodes located between the barrier filters (FIG. 15 elliptical).
Figure 14:
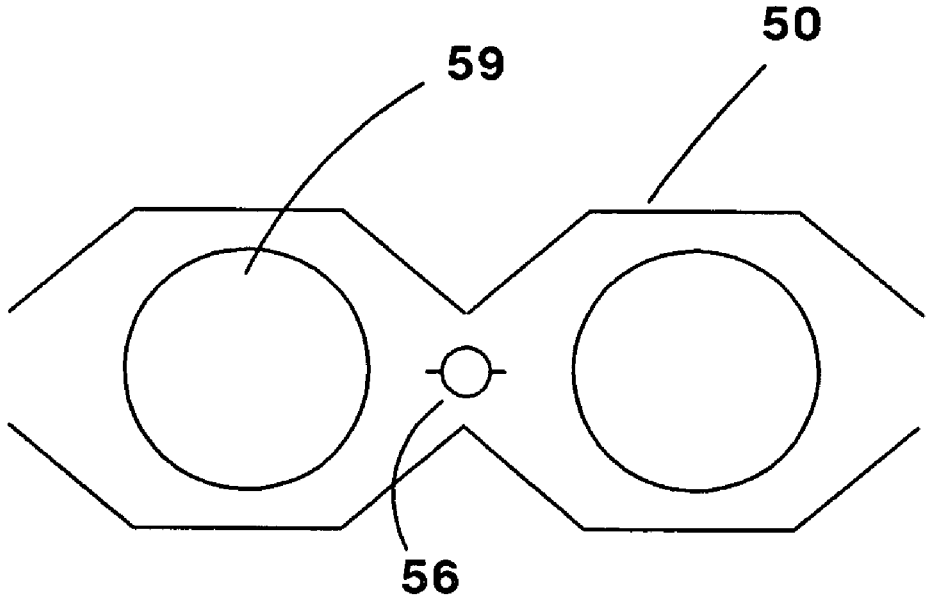

FIGS. 13–14 show a different arrangement for the electrode 56. In this embodiment, the electrode can be a rod or pipe, or any other shape that can extend the length of the barrier filters 59. The electrodes in FIGS. 13–14 are shown with wires attached; however, these wires are optional and not necessary for the functioning of the present invention. As with FIGS. 11–12, any type, shape, or design of electrode is within the scope of the present invention. The electrodes 56 in FIGS. 13–14 can generally be connected to approximately the same electrical potential as the filters 59. This is necessary to prevent any arcing between the electrode and the barrier filter that could damage the filter. It is within the scope of the present invention to design a barrier filter that allows arcing to it where the electrodes could be connected to an electrical potential significantly different from that of the filter.

Figure 15:
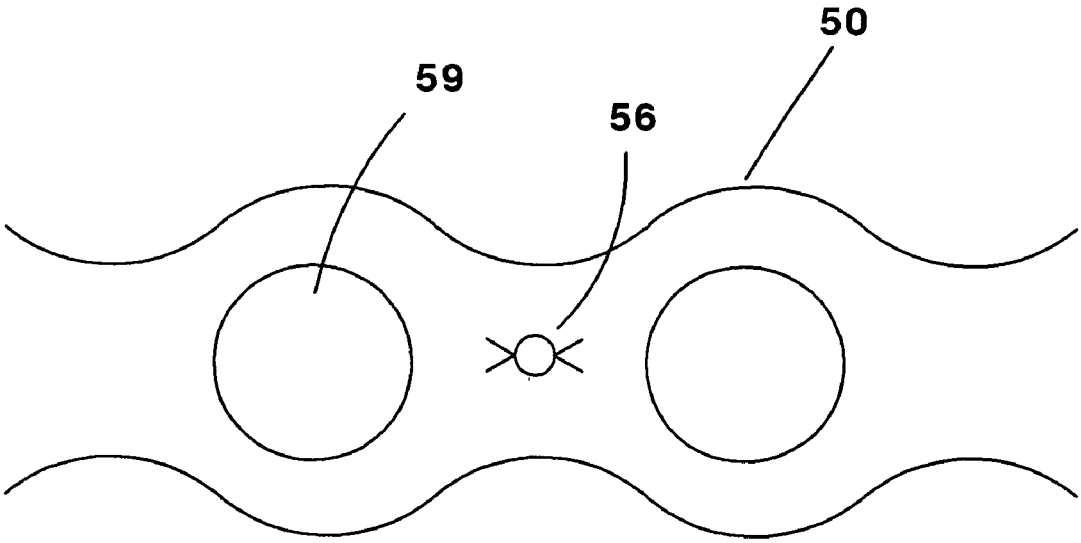

FIG. 15 shows a design with the electrodes 56 and the barrier filters 59 similar to previously explained embodiments, but with a more aerodynamic shape in the corrugated or parallel plates 50. This type of design allows the best flow pattern for the gas. Again, any type of electrode shape or design 56 can be located between the barrier filters 59 or attached to them. Again, the electrodes 56 are generally at the same or a similar potential as the barrier filters 59 to prevent arcing between them.

One skilled in the art will realize that any combination of barrier filters and electrodes is permissible and within the scope of the present invention including no electrodes at all. The object of the electrode system is to provide a source of ions that attach to particles in the gas flow giving them a charge. Any means or method of accomplishing this is within the scope of the present invention.

The present invention also finds particular use in high temperature, high-pressure applications, particularly, gasification plants, fluidized bed combustion, and other similar applications. The present invention is ideal for such an application because it is easily adaptable to operate at high temperatures and pressures. This can be done by using ceramic or other high temperature barrier filters as has been previously described. In particular, the present invention is resistant to ash buildup and bridging in this type of application.

In gasifier power applications, rather than filtering waste emission gases, the present invention can be used to filter gasses produced by the gasification process. Coal and other fuel gasification is usually accomplished by heating crushed coal in a high-pressure gas/oxygen atmosphere in a gasifying reactor. The super-heated coal produces hot combustion gases that are used to drive a gas turbine device (this could also be accomplished in an internal combustion engine). These hot gases are either used at temperatures around 800 degrees C. or are further heated to above 1200–1500 degrees C. with pressures as high as 16–26 bar. In particular, it is necessary to purify these gases of any remaining particulate matter before they are applied to the turbine. This can be done either before the so-called topping combustion device that further heats the gas or after it. Normally such filtering occurs before further heating. Devices to purify this type of gas should be designed to operate above 350 degrees C.

The present invention is ideal for such an application because it is easily adaptable to operate at high temperatures and pressures. This can be done by using ceramic or other high temperature barrier filters as has been previously described. In particular, the present invention is resistant to ash buildup and bridging in this type of application. The details of a gasifier power plant are given in U.S. Pat. No. 6,247,301, which is hereby incorporated by reference.

The present invention is also easily adapted to recover recyclable materials from waste gas streams. In this application, the residue materials which can contain metals of all types including heavy metals and precious metals, other inorganics such as halogens and halogen compounds and other inorganics, organics, gases and any other type of recoverable product. It is within the scope of the present invention to provide means for recovering particles that cling to the electrodes or barrier filters or to further route exhaust gas for recovery. For example, U.S. Pat. No. 6,482,373, which is hereby incorporated by reference, describes a process or recovering metals including arsenic components from ore, and U.S. Pat. No. 6,482,371, which is hereby incorporated by reference, describes recovering heavy metals and halogens from PVC and other waste materials or residue. Each of these processes requires an efficient filter such as that supplied by the present invention to perform the recovery task.

All collection surfaces described can be cleaned in a conventional manner such as by rapping, polarity reversal, or by other means. The barrier filter bags can be cleaned in a convention manner with pulsed air jets or by other means. Any means of cleaning the surfaces and/or bags is within the scope of the present invention.

Figure 16:
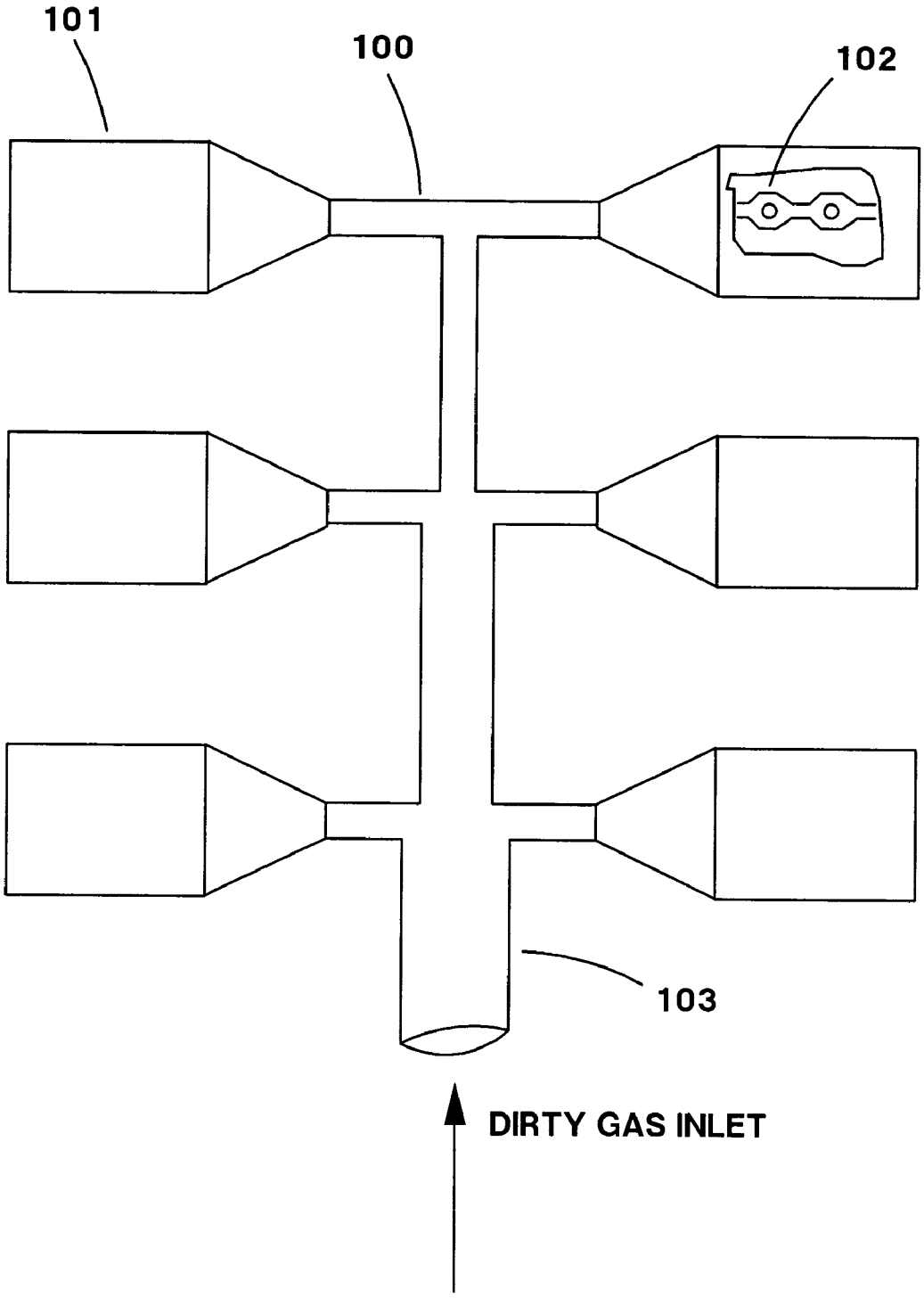
FIG. 16 shows a system of multiple collectors in parallel.
Figure 17:
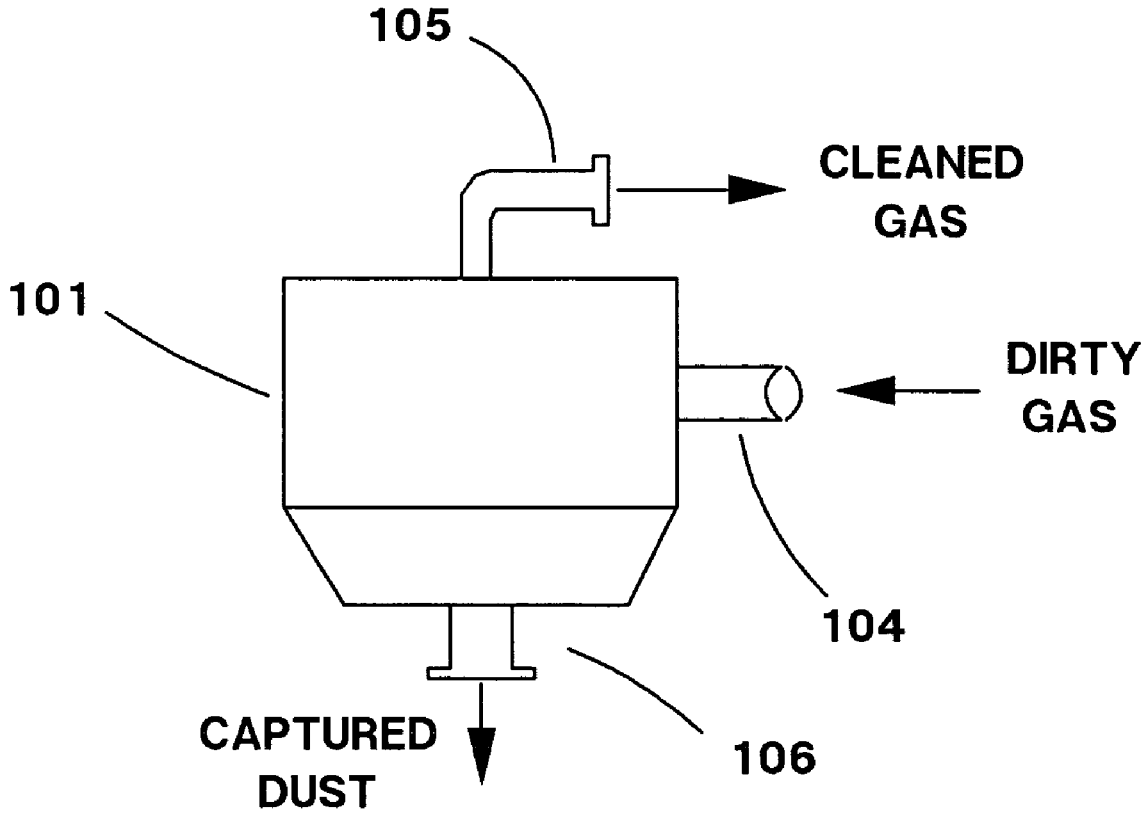
FIG. 17 shows a detail of one collector from FIG. 16.

In particular, the present invention is easily adapted to being used in a multi-collector or multi-compartment system. FIG. 16 shows a plurality of particulate collectors or collector compartments 101 connected in parallel. This method is effective for substantially increasing capacity for large volume or high-recovery systems. Each collector or compartment 101 is fed with a system of feeders 100 from a master or plurality of dirty gas inlets 103. Each collector or compartment 101 can contain the types of particulate collectors described herein 102 and/or can be combined with some more conventional systems such as bags only. FIG. 17 shows details of one possible such compartment or collector 101 with a dirty gas inlet 104, a clean gas outlet 105, and means of removing captured dust 106. As previously stated, the compartment or collector 101 can contain electrostatic, filter and other means discussed herein. Any collection means is within the scope of the present invention.

It is also possible to use embodiments of the present invention to remove pollutant gases from a flow such as $SO_2$, $NO_x$ HCl, mercury vapor, Freon, Dioxin and other compounds. To accomplish this, dielectric barrier discharge filters can be used and combined with the other features of the invention. A dielectric barrier discharge filter is one where the electrical corona actually discharges through a dielectic barrier such as the surface of a bag or ceramic barrier to an electrically conducting surface on the other side of the dielectric. In the case of a barrier or bag, a supported or even painted conductor can provide a point to discharge to. This type of discharge is usually accomplished using alternating current (AC) or short pulses. When AC is used, the frequency is usually less than 1 MHz.

Figure 18:
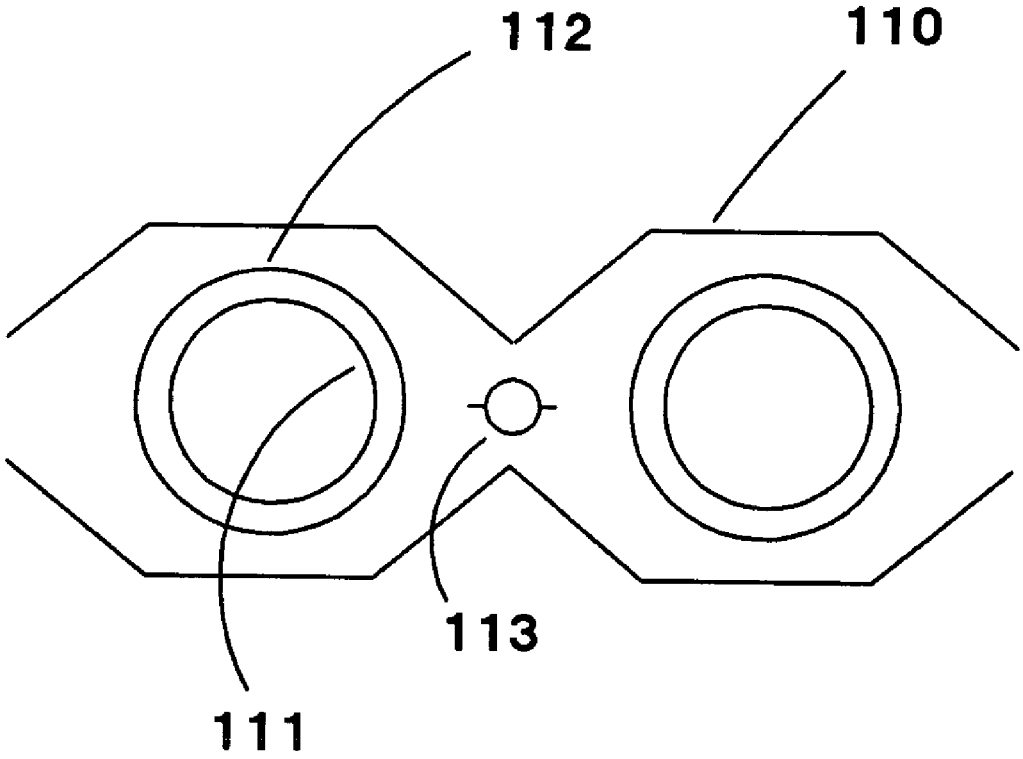
FIG. 18 shows a barrier discharge filter.

FIG. 18 shows how a dielectric barrier discharge filter can be incorporated into the present invention. A barrier 112 which has a dielectric surface can be inserted in a wide area (or anywhere) between a set of parallel plates 110. A conductor or conductive surface 111 can be located inside the barrier or bag (or painted on the inner surface of the barrier or bag). Discharge can take place from a normal discharge conductor 113 or from the surface of the parallel plate 110. The discharge through the dielectric barrier causes a portion of the chemical pollutants to be decomposed.

It is to be understood that the above-described arrangements are merely illustrative of the application of the principles of the invention, and that many other variations and arrangements may be devised by those skilled in the art without departing for the spirit of the invention. All such variations and arrangements are within the scope of the present invention.

I claim:

1. A multi-stage collector system for removing particulate and gaseous matter from a gas flow stream having a flow direction, the collector comprising:

at least one pair of parallel corrugated plate electrodes forming alternating narrow and wide regions in the direction of said flow stream, said plate electrodes connected to a first electrical potential;

said narrow regions containing a second electrode connected to a second electrical potential;

said wide regions containing a barrier filter, a part of said barrier filter being conductive and connected to a third electrical potential;

said first, second and third electrical potentials chosen to allow electric discharge between said second electrode and said plate electrodes or between said plate electrode and said barrier filter.

2. The multi-stage collector system of claim 1 wherein each of said corrugated plates contains sinusoidal corrugations.

3. The multi-stage collector of claim 1 wherein said second electrode is a flat plate with a sharp leading and/or trailing edge.

4. The multi-stage collector system of claim 1 wherein said second electrode has a circular cross-section.

5. The multi-stage collector system of claim 1 further comprising a means in communication with said electrodes and said barrier filter for recovering recyclable waste products.

6. The multi-stage collector system of claim 5 wherein said recyclable products contain metals.

7. The multi-stage collector system of claim 5 wherein said recyclable products contain halogens.

8. The multi-stage collector system of claim 1 wherein said gas stream is gas from a gasifier system.

9. The multi-stage collector system of claim 1 wherein said gas stream is from a fluidized bed combustion plant.

10. The multi-stage collector system of claim 1 wherein said gas stream has a temperature greater than 350 degrees C.

11. The multi-stage collector system of claim 1 wherein said gas stream has a pressure of greater than 5 bar.

12. A multi-stage collector system for removing particulate and gaseous matter from a gas flow stream, the collector comprising:

at least two plate electrodes in approximately parallel relation to each other extending in the direction of said gas flow stream, said plate electrodes forming alternating wide and narrow zones with each of said plate electrodes connected to a first electrical potential;

at least one hollow barrier filter made of an electrically insulating material situated in at least one of said wide zones;

a first electrode located inside said barrier filter, said first electrode connected to a second electrical potential;

a second electrode situated outside of said barrier filter in one of said narrow zones, said second electrode connected to a third electrical potential;

said first, second and third electrical potentials chosen to cause an electric discharge from said second electrode to at least one of said plate electrodes or from said second electrode to said first electrode through said barrier filter.

13. The multi-stage collector system of claim 12 wherein said second electrode is attached to said barrier filter.

14. The multi-stage collector system of claim 12 further comprising a means in communication with said electrodes and said barrier filter for recovering recyclable waste products.

15. The multi-stage collector system of claim 14 wherein said recyclable products contain metals or halogens.

16. The multi-stage collector of claim 12, wherein said hollow barrier filter has a cylindrical cross-section.

17. The multi-stage collector of claim 12 wherein said alternating wide and narrow zones are sinusoidal.

18. The multi-stage collector of claim 12 wherein said first electrode is a conductively coated inner surface of said hollow barrier filter.

19. A method of collecting particulate matter and converting waste gases in a multi-stage collector system comprising the steps of:

passing a stream of gas through a pair of approximately parallel plates, said plates being at a first electrical potential;

placing at least one hollow dielectric barrier filter between said plates, said hollow barrier filter containing an electrode being at a second electrical potential;

placing a discharge electrode between said plates at a position outside of said barrier filter, said discharge electrode being at a third electrical potential;

choosing said first and second electrical potentials to cause an electric discharge from said plate electrode through said barrier filter to said electrode in said barrier filter.

20. The method of claim 19 further comprising choosing said first and third electrical potentials to cause an electric discharge from said discharge electrode to at least one of said plates.

* * * * *